US006539931B2

(12) United States Patent
Trajkovic et al.

(10) Patent No.: US 6,539,931 B2
(45) Date of Patent: Apr. 1, 2003

(54) BALL THROWING ASSISTANT

(75) Inventors: Miroslav Trajkovic, Ossining, NY (US); Eric Cohen-Solal, Ossining, NY (US); Srinivas Gutta, Buchanan, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 17 days.

(21) Appl. No.: 09/835,454

(22) Filed: Apr. 16, 2001

(65) Prior Publication Data

US 2002/0148455 A1 Oct. 17, 2002

(51) Int. Cl.[7] ..... A63B 69/40; F41B 4/00

(52) U.S. Cl. ..... 124/34; 124/6; 124/32; 124/78

(58) Field of Search ..... 124/6, 31, 32, 124/34, 78

(56) References Cited

U.S. PATENT DOCUMENTS 5,125,653 A * 6/1992 Kovacs et al. ..... 124/78 X
5,359,576 A * 10/1994 Bunner et al. ..... 124/34 X
5,464,208 A * 11/1995 Pierce ..... 124/78 X
6,152,126 A * 11/2000 Smith et al. ..... 124/78
6,190,271 B1 * 2/2001 Rappaport et al. ..... 124/78 X
6,195,017 B1 * 2/2001 Smith et al. ..... 124/78 X
6,244,260 B1 * 6/2001 Ragoza et al. ..... 124/34
6,371,871 B1 * 4/2002 Rappaport et al. ..... 124/6 X

* cited by examiner

*Primary Examiner*—John A. Ricci
(74) *Attorney, Agent, or Firm*—John Vodopia

(57) ABSTRACT

A ball-throwing machine includes a camera connected to a computer vision unit and a microphone connected to a speech-processing unit. The computer vision unit processes images from the camera to determine a user's position, and to detect user gestures from a predetermined repertoire of gestures. The speech-processing unit recognizes user vocal commands from a predetermined repertoire of commands. A computer receives information from a control panel, from the computer vision unit, from the speech-processing unit, and from a file describing the ballistic properties of the ball to be thrown. The computer accordingly determines a ball trajectory according to the user's position and parameters indicated by a combination of control-panel settings, user gestures, and user vocal commands. The computer then adjusts the direction, elevation, ball speed, and ball spin to conform to the determined trajectory, and initiates throwing of a ball accordingly.

12 Claims, 3 Drawing Sheets

BALL THROWING ASSISTANT

BACKGROUND OF THE INVENTION

1. Field of the Invention

This invention relates to an apparatus and method for controlling the operation of a ball-throwing machine.

2. Description of the Related Art

There are many kinds of automatic ball throwing machines, intended to aid sports practice for players of ball-oriented sports. These machines automatically throw balls in a desired direction to allow people to train, practice, and build skills at playing various kinds of sports. For example, a softball throwing machine like pitching machines from The Jugs Company® throws softballs or baseballs. One can set the pitching machines to throw a particular type of pitch selected from a variety of predefined pitch types, such as fastballs, curveballs, sliders, etc., and some of the machines offer the option of making various adjustments that can be made to the speed at which the pitches are thrown, the angle at which they are thrown, whether they are thrown to simulate throwing by a left-handed or a right-handed pitcher.

Similarly, a tennis ball throwing machine, such as machines from Lob-ster Inc. throws tennis balls to provide a user with practice at hitting tennis balls. The Lob-ster 301 Tennis Ball Throwing Machine can, for example, be set to throw a ball toward the same place repeatedly, or can be set to oscillate horizontally which creates a random pattern of shots from tennis court sideline to sideline for more realistic practice.

Other types of ball throwing machines that each throw a different type of ball, such as footballs, soccer balls, etc. also exist. Some of these machines can be operated in different modes.

These machines suffer from several disadvantages. First, triggering the machine to throw a ball is cumbersome. For example, the user can arrange for a machine operator to stand beside the ball-throwing machine and can then instruct the operator when to activate the machine to throw a ball. Or the user can trigger the throwing of a ball by pressing on a remote foot switch, which requires the user to momentarily vacate the stance he prefers for interacting with the ball. A second disadvantage is that variable settings must be changed manually. Thus, for example, where a ball-throwing machine is set to throw a baseball at 50 miles per hour and the user wants to change the setting so that a ball is thrown at 75 miles per hour, the user must leave his position, go to the machine, and manually change the machine setting. A manual adjustment is also required, for example, when changing a pitch type.

SUMMARY OF THE INVENTION

It is an object of the present invention to provide an apparatus and method for adjusting according to a user's commands the machine-throwing of a ball to the user for a sports-related action. A ball-throwing machine having an impeller also has a camera and a microphone for monitoring the user. A computer vision unit processes images from the camera to monitor the user's position and to detect gestures made by the user. An audio processor processes signal from the microphone to detect sounds made by the user including vocal commands. A computer responsive to the computer vision unit, the audio processor, settings on a control panel, and data describing ballistic characteristics sets the impeller angle in both horizontal and vertical directions, the impeller speed, and the spin the impeller will impart to the ball, and causes a ball to be fed to the impeller for projection under the current settings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
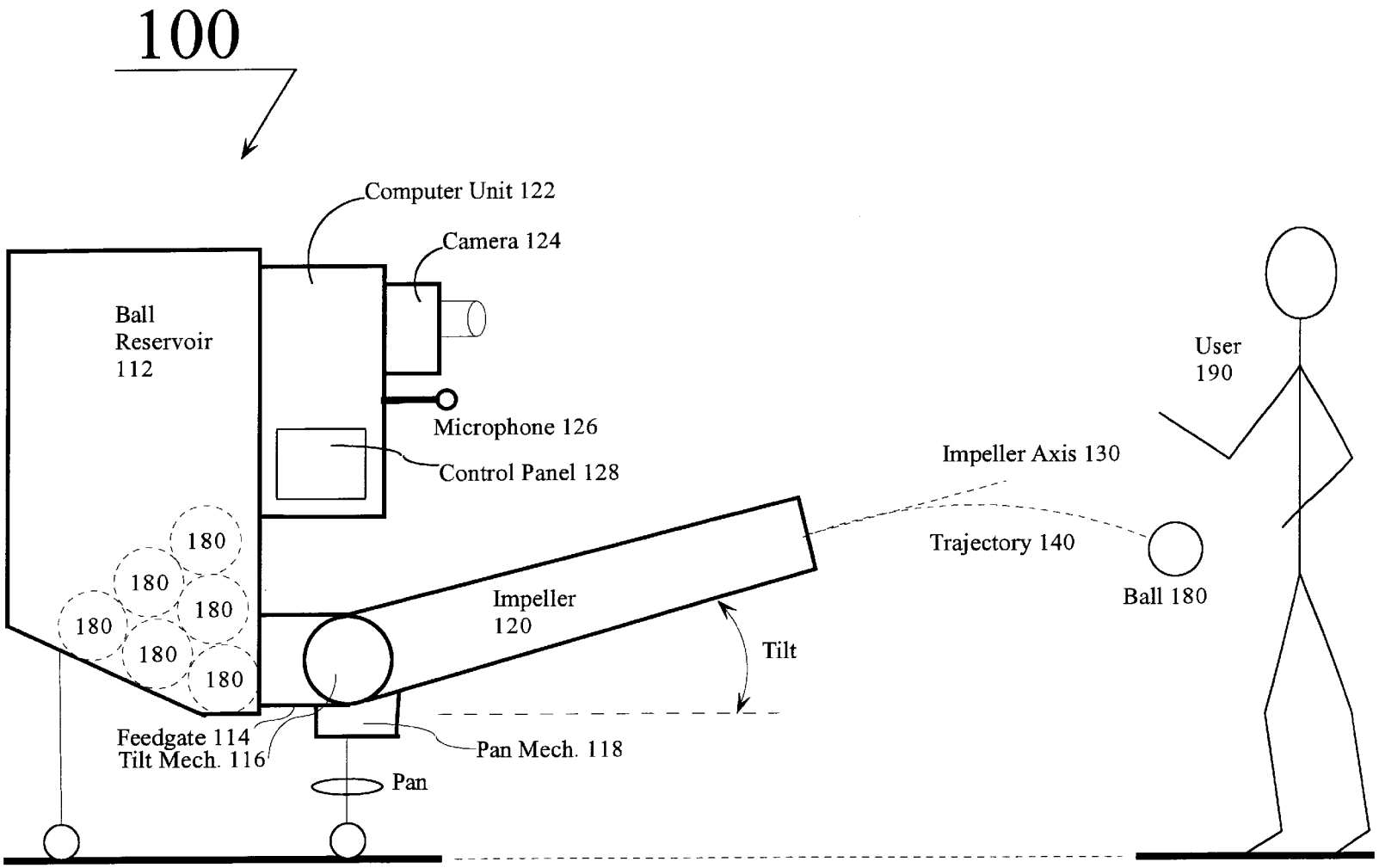
FIG. 1 is a perspective view of a ball-throwing machine according to the present invention.

FIG. 1 depicts a possible physical appearance of a ball-throwing machine 100 in accordance with the present invention. Balls 180 to be projected are loaded into ball reservoir 112, from which they reach feedgate 114. A method as simple as gravity can be used to route the balls 180 into feedgate 114, and the geometry of feedgate 114 can be arranged such that only a single ball 180 may enter it at any one time. Activation of feedgate 114 introduces a ball 180 into impeller 120, which projects the ball 180 along impeller axis 130 toward a user 190. The general orientation of ball-throwing machine 100 establishes a direction in which the ball 180 is propelled. Adjustments in the direction may be effected by activating pan mechanism 118, which alters the angle of impeller axis 130 in a horizontal plane. Adjustments in the vertical angle of impeller axis 130 may by effected by activating tilt mechanism 116. A control panel 128 has manual controls which may be used to turn ball-throwing machine 100 on and off and setting parameters of the machine such as the speed at which the impeller projects a ball. It may also be used for controlling tilt mechanism 116 and pan mechanism 118, although in some prior-art embodiments those mechanisms may be directly manually operated.

Some or all of the features mentioned thus far may appear on prior-art ball-throwing machines as well as on ball-throwing machine 100 of the present invention. The ball-throwing machine 100 of the present invention further includes a computer unit 122, a camera 124 (preferably but not necessarily a stereo camera), and a microphone 126. The camera 124 is positioned so as to capture images of the user 180. The microphone 126 is arranged to pick up the user's speech. In one embodiment it has directional characteristics chosen so as to minimize sound pickup from locations other than the vicinity of the user 190. In another embodiment it is a cordless microphone deployed on the user's person and connected cordlessly to ball-throwing machine 100. Computer unit 122 analyzes images from camera 124 to determine the current position of the user 190 and to control parameters of ball projection accordingly. Computer unit 122 also speech-processes user speech from microphone 126 to identify user 190's commands to accordingly alter parameters of ball-throwing machine 100. Computer unit 122 also analyzes images from camera 124 to detect predetermined gestures by the user 190 in order to adjust parameters of ball-throwing machine 100 in accordance with user 190's gestures.

Figure 2:
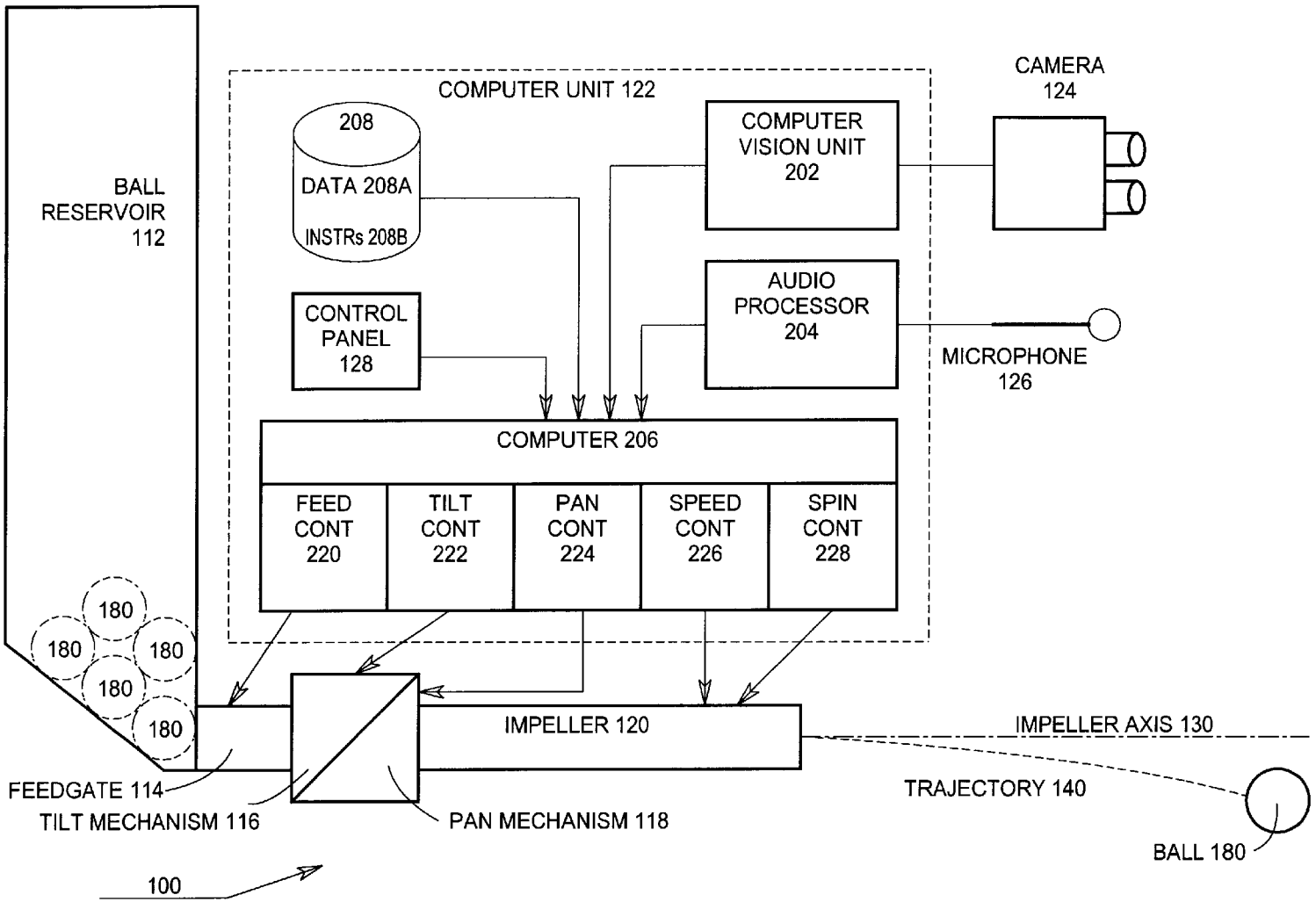
FIG. 2 is a block diagram depicting the system architecture for controlling the ball throwing machine in accordance with the embodiment of the present invention shown in FIG. 1.

FIG. 2 is a block diagram of the components of ball-throwing machine 100 together with elements and paths for controlling them. Impeller 120 may be as in prior-art ball throwing machines. A common type of prior-art ball impeller comprises two rotating rollers with axes in a vertical plane perpendicular to impeller axis 130 and with sufficient space between the rollers to snugly fit a ball between them. The rollers are driven to rotate in opposite angular directions, such that surfaces of both are moving in the same linear direction at the points at which they contact a ball introduced between them, a direction along impeller axis 130 toward the user. The ball is thereby propelled along impeller axis 130, at a speed determined by the speed of the rollers and the snugness of the fit of the ball between the rollers. Those parameters may be adjusted in order to determine the speed of the propelled ball. The geometry of the impeller, including the spacing between the rollers, is set so as to be suitable for the particular type of ball to be thrown: tennis ball, baseball, softball, volleyball, soccer ball, football, etc. Rotating the rollers at slightly different speeds imparts to the ball a spin about the vertical axis, which may be used, for example, to emulate the action of baseball pitches such as curve balls, sliders, etc. If the axes of the rollers are slightly askew, the ball will move vertically, during the time it is being impelled, toward the wider portion of the gap between the rollers, imparting to the ball a spin about the horizontal axis. Such spin may be used, for example, to produce topspin or backspin on tennis balls or the end-over-end flight of a kicked football.

Although the present discussion is directed to propelling balls, it is understood that the system and method of the present invention may be used with a suitable impeller to propel other types of projectiles, for example the clay discs known as "skeet" used in the shotgun practice known as "skeet shooting".

Ball reservoir 112 may be as in the prior art. Feedgate 114 and tilt and pan controls 116 and 118 may be as in the prior art, provided that they are operable in response to electrical signals as opposed to being directly manually operated. Computer unit 122 includes computer vision unit 202, audio processor 204, and computer 206. Computer 206 may access data storage unit 208, which stores data 208A and program instructions 208B. Operatively connected to and responsive to computer 206 are feed control unit 220, tilt control unit 222, pan control unit 224, speed control unit 226, and spin control unit 228.

Camera 124 is aimed at the user, and dynamically captures images of the user. Computer vision unit 202 processes the images to dynamically keep track of the user's position. This is accomplished by means known in the art. See, for example, *Introductory Techniques for* 3-*D Computer Vision*, Emanuele Truco and Alessandro Verri, Prentice Hall, 1999, particularly at Chapter 7, *Stereopsis,* which provides methods for determining the locations of points in a pair of stereo images. A camera 124 that is not a stereo camera can be used provided that ball-throwing machine 100 and the user are both on the same planar surface. The user may then be located by the camera by locating contact between the user's feet and the planar surface. Extrapolating from the determination of locations of a collection of points to a determination of the location of a human being who includes those points is expostulated in, for example, *Pedestrian Detection from a Moving Vehicle*, D. M. Gavrila, Daimler-Chrysler Research, Ulm, Germany, and in *Pfinder: Real-Time Tracking of the Human Body*, C. Wren et al, MIT Media Laboratory, published in IEEE Transactions on Pattern Analysis and Machine Intelligence, July 1997, vol. 19., no. 7, pp. 780–785. After the user is identified in the images, his position may be determined through triangulation. Positional information regarding the user is forwarded from computer vision unit 202 to computer 206 for use in controlling the mechanisms of ball-throwing machine 100 as will be discussed below.

Computer vision unit 202 also interprets images from camera 124 to detect gestures made by the user. Methods for such computer interpretation of gestures are given in *Television Control by Hand Gestures*, W. T. Freeman & C. D. Weissman, Mitsubishi Electric Research Labs, IEEE International Workshop on Automatic Face and Gesture Recognition, Zurich, June, 1995, and in U.S. Pat. No. 6,181,343, *System and Method for Permitting Three-Dimensional Navigation through a Virtual Reality Environment Using Camera-Based Gesture Inputs*, Jan. 30, 2001 to Lyons. Information identifying gestures made by the user is forwarded to computer 206 for use in controlling ball-throwing machine 100.

Audio processor 204 interprets audio from microphone 126 and identifies at least predetermined vocal commands from the user. Computer speech recognition is known in the art, as in, for example, the widely-available PC programs ViaVoice® and NaturallySpeaking®. Information regarding identified vocal commands is forwarded to computer 206 for controlling ball-throwing machine 100. Signals resulting from manual operation of control panel 128 are also provided to computer 206. Audio processor 204 may also identify certain non-vocal sounds, such as a handclap or the crack of a bat hitting a ball, for interpretation in controlling ball-throwing machine 100.

Computer 206 is programmed to deploy feed control 220, tilt controller 222, pan controller 224, speed control 226, and spin control 228 so as to propel a ball in a manner advantageous to the user. It is a matter of design choice what preferences the user may express and in which manner (e.g., an initial set-up of control panel 128, by vocal command, by gesture, according to the user's position, etc.) For example, on a baseball-throwing machine it may be made selectable on control panel 128 whether a user wishes to practice batting, fielding of batted balls, or catching throws from other players, and whether the user is left-handed or right-handed. If a user wants to practice right-handed batting, for example, computer 206 determines that the ball is to be thrown past the user on his right side. If a user wants to practice catching throws from other players ("infield practice"), for example, computer 206 determines that balls are to be thrown directly at the user. If a user wants to practice fielding of batted balls, computer 206 determines impeller parameters so as to simulate ground balls, line drives, fly balls, or pop-ups. The user might specify one of those types, or a random mix of them. He might specify a range of distance from himself to the ball's trajectory, simulating game conditions where a ball to be fielded is in a player's vicinity but not aimed directly at him.

As a matter of design choice, control panel 128 may accept some of the user's preferences at the start of a session.

The present invention permits changing the characteristics of thrown balls dynamically during the session according to the user's position and according to commands given by the user, as vocal commands, non-vocal sounds such as hand-claps or bat-cracks, or by gestures. For example, a user taking batting practice might vocally call out the type of pitch he wants (curve ball, fastball, etc.). He might vocally indicate where he wants the trajectory of the pitch (e.g., "high and outside"), or in the alternative he might momentarily hold his hand palm-open at a point on the desired trajectory. Pitches might be set to occur at some predetermined rate, or some predetermined time after a bat-crack from a previous pitch, or in the alternative a pitch might occur in response to a predetermined vocal command, or in response to detecting that the user has gotten into his batting stance. For fielding practice, for a further example, the user might request a ground ball by pointing straight down, a line drive by pointing sideways at a low angle, a fly ball by pointing sideways at a high angle, and a pop-up by pointing straight up. He might request a random mix of those types by moving his arm through an arc from straight down to straight up. In the alternative, the user might make these requests vocally into microphone 126. Since the user is typically at a considerable distance from ball-throwing machine 100 for fielding practice, microphone 126 may be embodied as a cordless microphone and deployed on the user's person. The user might also give vocal commands specifying the location of the throw (e.g., "far to my left", "near to my right", etc.). The speed of the throw may be specified by predetermined gestures or by predetermined vocal commands (e.g., "hard", "medium", "soft", "slower", "faster"). Vocal commands for grosser control of the ball-throwing machine 100 (e.g., "start", "stop") may also be in the recognized repertoire of vocal commands.

Data 208A informs computer 206 of ballistic characteristics for the type of ball or projectile to be thrown. At most typical distances, the ball trajectory 140 deviates from the impeller axis 130 by an amount which can be determined from ball 180's ballistic characteristics, which in turn may be empirically predetermined.

Computer 206 is thus informed of the user's position by computer vision unit 202. Computer 206 learns the kind of throw the user wants by a combination of the settings on control panel 128, user vocal commands picked up by microphone 206 and identified by audio processor 204, and/or user gestures by computer vision unit 202. Computer 206 also knows from data 208A the ballistic characteristics of the ball 180. Computer 206 is programmed by instructions 208B to calculate accordingly the required speed and spin and a trajectory 140. Computer 206 instructs feed control 222 and pan control 224 to actuate tilt mechanism 116 and pan mechanism 118 respectively to bring impeller axis 130 into conformity with the beginning of determined trajectory 140. One of the factors in the determination of trajectory 140 is the current location of the user; if the user has moved since the last throw, pan and tilt mechanisms 118 and 116 are activated to keep the user nominally centered in camera 124's field of view. Computer 206 instructs speed control 226 and spin control 228 to set mechanical elements of impeller 120 to provide the ball speed and spin determined necessary for the user-requested throw. Computer 206 determines according to user desires (preset on control panel 128 or dynamically given through vocal commands or gestures (including stance)) when to make the throw and instructs feed control 220 to actuate feedgate 114, completing the operation of making the desired throw to the user.

Figure 3:
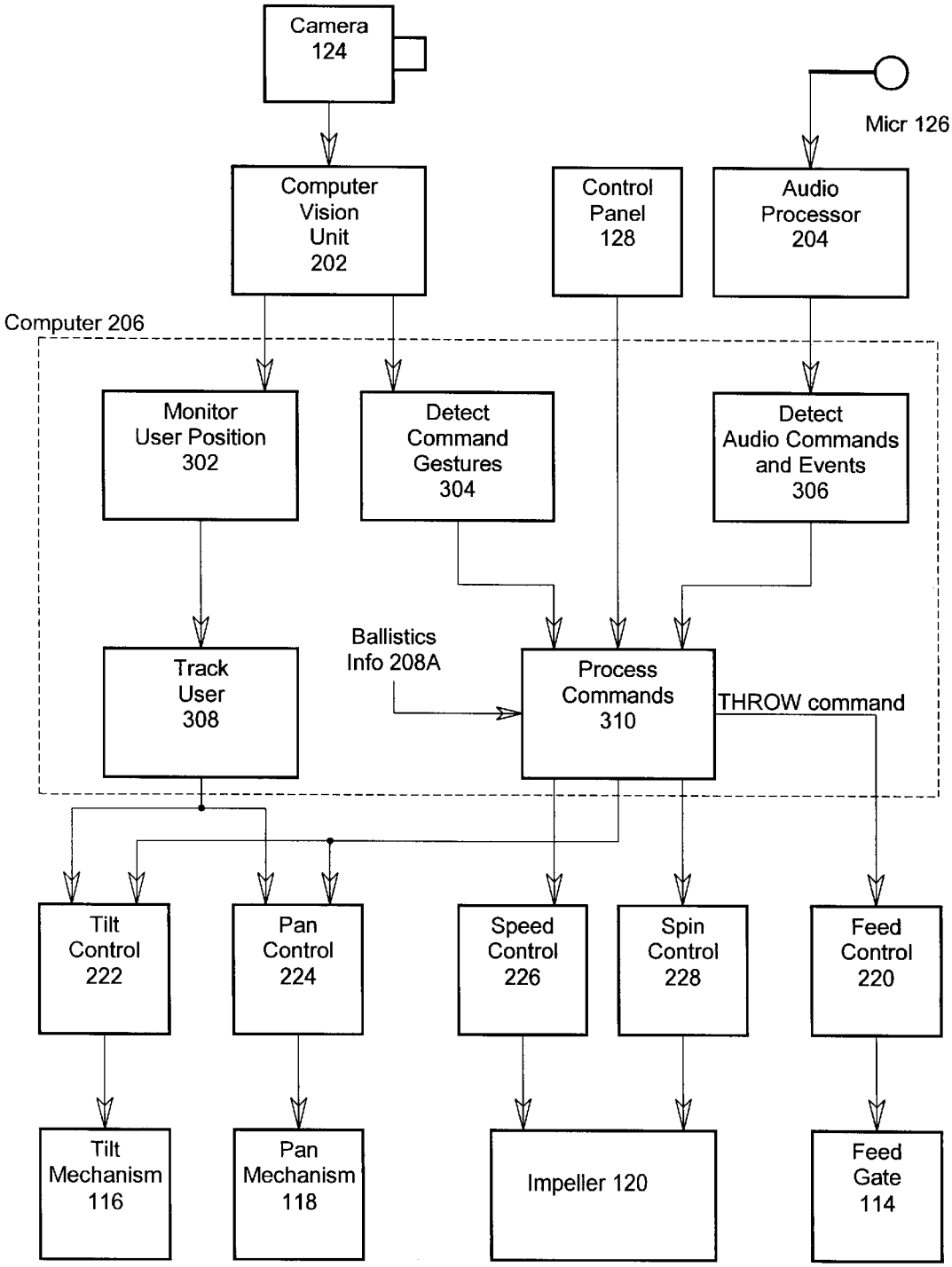
FIG. 3 is a flow chart of functional operations to effect multimodal control in accordance with the present invention to activate the ball-throwing machine.

FIG. 3 depicts the functional operations that takes place within computer 206. In a preferred embodiment, computer 206 is a programmed digital computer and blocks 302, 304, 306, 308, and 310 introduced in FIG. 3 are software modules effected by the computer's interpretation of instructions 208B.

In block 302, images from camera 124 as processed by computer vision unit 202, indicative of the user's position, are analyzed and the user's position relative to camera 124's field of view and the present impeller axis 130 is determined. Block 302 signals block 308 if adjustments are necessary to keep the user nominally centered in camera 124's field of view. In block 308, appropriate signals are generated to instruct tilt and pan controls 222, 224 to control tilt and pan mechanisms 116, 118 accordingly.

Block 304 receives from computer vision 202 information derived from camera images of the user, and detects whether the user makes any of the gestures in a predetermined repertoire of gestures, including such as getting into his batting stance. Block 306 receives information from audio processor 204, and notes predetermined vocal commands or non-vocal audio events such as hand-claps and bat-cracks.

In block 310, all user preferences including settings made on control panel 128, gestures reported by block 304, and vocal commands and audio events reported by block 306 are multi-modally processed, in conjunction with ballistics information 208A, in order to set ball-throwing machine 100 such that the next throw will conform to the user's expressed wishes. Appropriate signals are sent to speed control 226 and spin control 228 to set the flight characteristics of the next thrown ball. Signals are sent to tilt control and pan control 222, 224 that may adjust the trajectory slightly away from the setting directed by block 308, for cases where the user requests, for example, an outside pitch or a fly ball a distance from him.

The settings directed by blocks 308 and 310 change in an ongoing manner as the user moves and/or makes new requests through gestures and audio commands or actions. The settings that are in effect at the time a THROW command is generated determine the characteristics of the throw. As noted above, the THROW command may be generated as a result of a gesture, audio action, or settings entered in control panel 128 (e.g., every n seconds). The THROW command instructs feed control 220 to cause feedgate 114 to admit a ball to impeller 120, resulting in a throw.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed is:

1. An apparatus for propelling a projectile for an action by a user, the apparatus comprising:

an impeller for receiving a projectile and projecting it along an impeller axis;

detecting means for detecting a command signal corresponding to one of a gesture made by the user and a sound made by the user;

data processing means operatively connected to the detecting means for determining a projection axis and projection speed according to at least ballistic characteristics of the projectile and the detected command signal;

impeller control means responsive to the data processing means and operatively connected to the impeller for adjusting:

impeller projection speed according to the determined projection speed, and impeller position to conform the impeller axis with the determined projection axis; and a feed mechanism for introducing a projectile into the impeller for projection.

2. The apparatus according to claim 1, wherein the detecting means includes a microphone for receiving sound made by the user and a sound processing means connected from the microphone for recognizing predetermined sounds made by the user, each sound corresponding to one of said command signals.

3. The apparatus according to claim 1, wherein the detecting means includes a camera for receiving images of the user and an image processing means connected from the camera for detecting gestures made by the user, each gesture corresponding to one of said command signals.

4. The apparatus according to claim 3, wherein the image processing means further determines user position, and determining the projection axis is further according to the user position.

5. The apparatus according to claim 3, wherein the detecting means includes a microphone for receiving sound made by the user and a sound processing means connected from the microphone for recognizing predetermined sounds made by the user, each sound corresponding to one of said command signals.

6. The apparatus according to claim 1, wherein:

the impeller has the ability to impart spin to the projectile, and the command signals include command signals for increasing spin and decreasing spin, whereby a repertoire of baseball pitches are simulated.

7. A method of propelling a projectile for an action by a user, the method comprising the steps of:

arranging an impeller to receive a projectile and project it along an impeller axis;

detecting a command signal corresponding to one of a gesture made by the user and a sound made by the user;

determining a projection axis and projection speed according to at least ballistic characteristics of the projectile and the detected command signal;

setting the impeller's projection speed according to the determined projection speed;

setting the impeller's position to conform the impeller axis with the determined projection axis; and introducing a projectile into the impeller for projection.

8. The method according to claim 7, wherein the detecting step includes receiving with a microphone sound made by the user and a processing signal from the microphone to recognize predetermined sounds made by the user, each sound corresponding to one of said command signals.

9. The method according to claim 7, wherein the detecting step includes receiving with a video camera images of the user and processing signal from the camera to recognize predetermined gestures made by the user, each gesture corresponding to one of said command signals.

10. The method according to claim 9, wherein the detecting step further determines user position, and the step of determining the projection axis is further according to the user position.

11. The method according to claim 10, wherein the detecting step includes receiving with a microphone sound made by the user and processing signal from the microphone to recognize predetermined sounds made by the user, each sound corresponding to one of said command signals.

12. The method according to claim 7, wherein:

the impeller is further arranged to impart spin to the projectile, and the command signals include command signals for increasing spin and decreasing spin, whereby a repertoire of baseball pitches are simulated.

* * * * *